United States Patent [19]

Sundberg et al.

[11] Patent Number: 4,711,619

[45] Date of Patent: Dec. 8, 1987

[54] VANE FUEL PUMP HAVING REDUCED DISPLACEMENT AT HIGH SPEEDS

[75] Inventors: Jack G. Sundberg, Meriden; Godwin L. Noell, Winsted, both of Conn.

[73] Assignee: Colt Industries Inc., New York, N.Y.

[21] Appl. No.: 933,664

[22] Filed: Nov. 21, 1986

[51] Int. Cl.[4] ..... F03C 2/00; F04C 2/00; F04C 15/04

[52] U.S. Cl. ..... 418/27; 418/31

[58] Field of Search ..... 417/220; 418/1, 25, 418/27, 31

[56] References Cited

U.S. PATENT DOCUMENTS 2,592,247 4/1952 Coe ..... 418/27

3,645,652 2/1972 Cygnor ..... 418/31

*Primary Examiner*—Carlton R. Croyle

*Assistant Examiner*—Leonard P. Walnoha

*Attorney, Agent, or Firm*—Richard A. Dornon; Howard S. Reiter

[57] ABSTRACT

A variable displacement vaned fuel pump (10) is suitable for inclusion in a fixed displacement fuel control system for a gas turbine engine. The pump includes two track elements (34,36) having cam surfaces (42) which engage cam followers (44) on a cam actuation ring (40). A link (66) having a predetermined spring load maintains the track elements in their radially inner maximum displacement positions until the vane force and pressure forces drive the track elements radially outwardly, moving the actuation ring against its spring load. Displacement of the pump is reduced in the radially outward positions of the track elements which reduces the required bypass flow to hold a head constant across a fuel metering valve and attendant fuel heating.

4 Claims, 4 Drawing Figures

TYPICAL FIXED SYSTEM

Fig.4 PROPOSED
VARIABLE/FIXED

VANE FUEL PUMP HAVING REDUCED DISPLACEMENT AT HIGH SPEEDS

TECHNICAL FIELD

This invention relates to fuel pumps, and more particularly, to aircraft gas turbine fuel pumps.

BACKGROUND ART

Variable displacement vane pumps utilizing two rigid track elements or seal blocks to define a vane tip cam surface or vane tip track are known in the prior art. In such a pump (which is illustrated in U.S. Pat. No. 3,645,652), the track elements may be positioned anywhere between maximum and minimum displacement settings to satisfy flow requirements without mandating undesirable flow bypassing throughout the range of operation.

Conversion of a variable displacement vane pump, as above-described, to a fixed displacement pump can be attained by simply disabling the actuator control system. A converted variable displacement vane pump can, of course, be utilized in any fuel control system which requires a fixed displacement pump but obviously without offering the attendant advantages of a variable displacement pump which prominently include reduced fuel temperature rise at high turndown ratios due to the lack of fuel bypassing.

DISCLOSURE OF THE INVENTION

In accordance with the invention, there is provided a variable displacement vane pump modified in such a manner as to generate a sufficient starting flow in a fixed displacement fuel control system and yet furnish a reduced displacement at higher speeds to minimize fuel bypassing and, hence, fuel heating. A vane pump of the invention may have two track elements in surrounding relationship to a rotor with a plurality of vanes which together define a vane tip tracking surface. At least one of the track elements has a cam surface thereupon which is engaged by an associated cam member on a cam actuation device mounted for rotation around the track elements.

Instead of an actuator positioning the cam actuation device and thereby controlling displacement of the pump (e.g., to hold a constant pressure head across a metering valve), a pump according to the invention has the cam actuation device positioned by pressure forces acting on the vane tip tracking surface which tend to drive the track element in the outboard direction. A bias force is applied to the cam actuation device by a spring assembly or the like to prevent the track elements from moving in the outboard direction (and thereby changing the displacement of the pump) until the pump developes sufficient pressure. When the bias force is overcome, the track elements will move the cam actuation device and thereafter assume a new reduced displacement position. With the track elements in their new position, the pump acts as a fixed displacement pump but provides less flow for a given speed than it would have provided had the track elements been maintained in their original positions, thereby to reduce fuel bypassing.

Accordingly, it is a primary object of the invention to provide a variable displacement vane type fuel pump suitable for inclusion in a fixed displacement fuel control system.

Another object is to provide a fuel pump for a fixed displacement fuel control system which minimizes fuel bypassing.

These and other objects and advantages of the invention will become more readily apparent form the following detailed description when taken in conjunction with the accompanying drawings, in which:

BRIEF DESCRIPTION OF DRAWINGS

FIG. 4 is a graph showing flow versus speed for a preferred pump of the invention.

BEST MODE OF CARRYING OUT THE INVENTION

Figure 1:
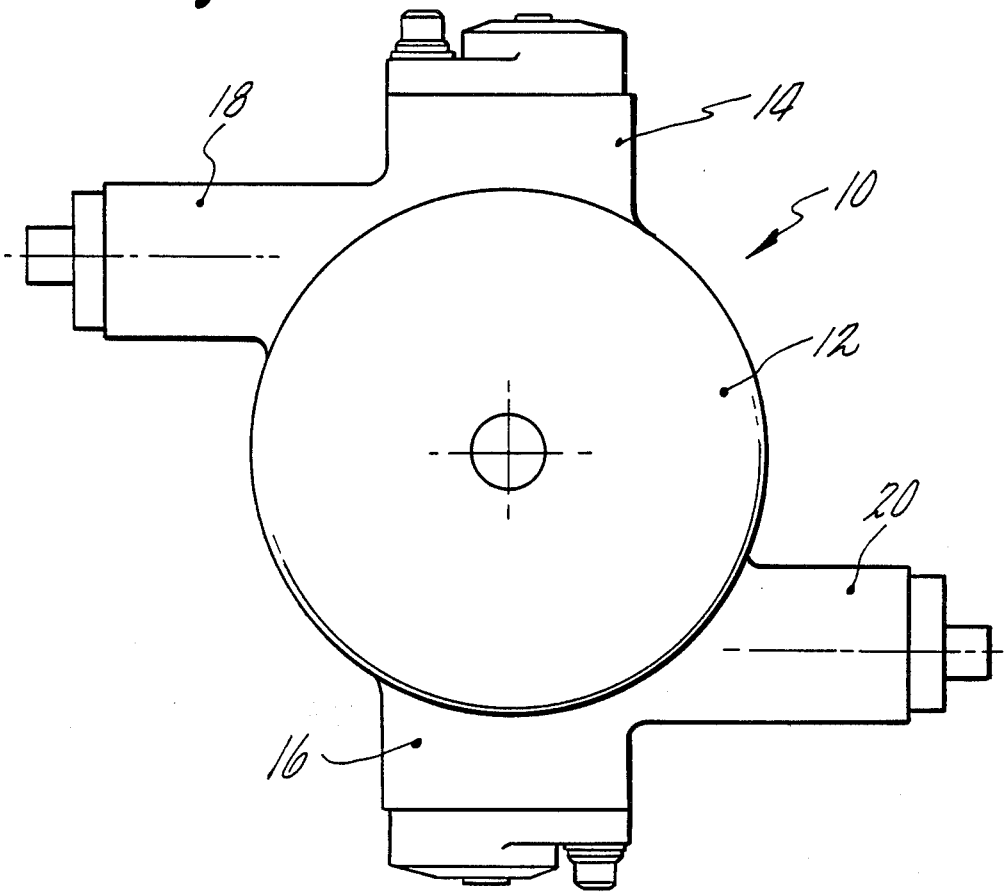
FIG. 1 is an elevational view of a pump according to the invention.

Referring to FIG. 1, there is shown a vane pump 10 according to the invention. Pump 10 includes a housing 12 in which the basic elements of the pump are contained. The pump housing 10 includes a first pair of diametrically opposed extensions 14 and 16 and a second pair of diametrically opposed extensions 18 and 20. Extensions 14 and 16 function to respectively house balance piston assemblies while extensions 18 and 20 serve to respectively house bias torque assemblies as more fully explained hereinafter. In general, pump 10 is virtually identical to the pump shown in U.S. Pat. No. 3,645,652 save for the lack of an actuator system to control displacement and the addition of a torque bias arrangement.

Figure 2:
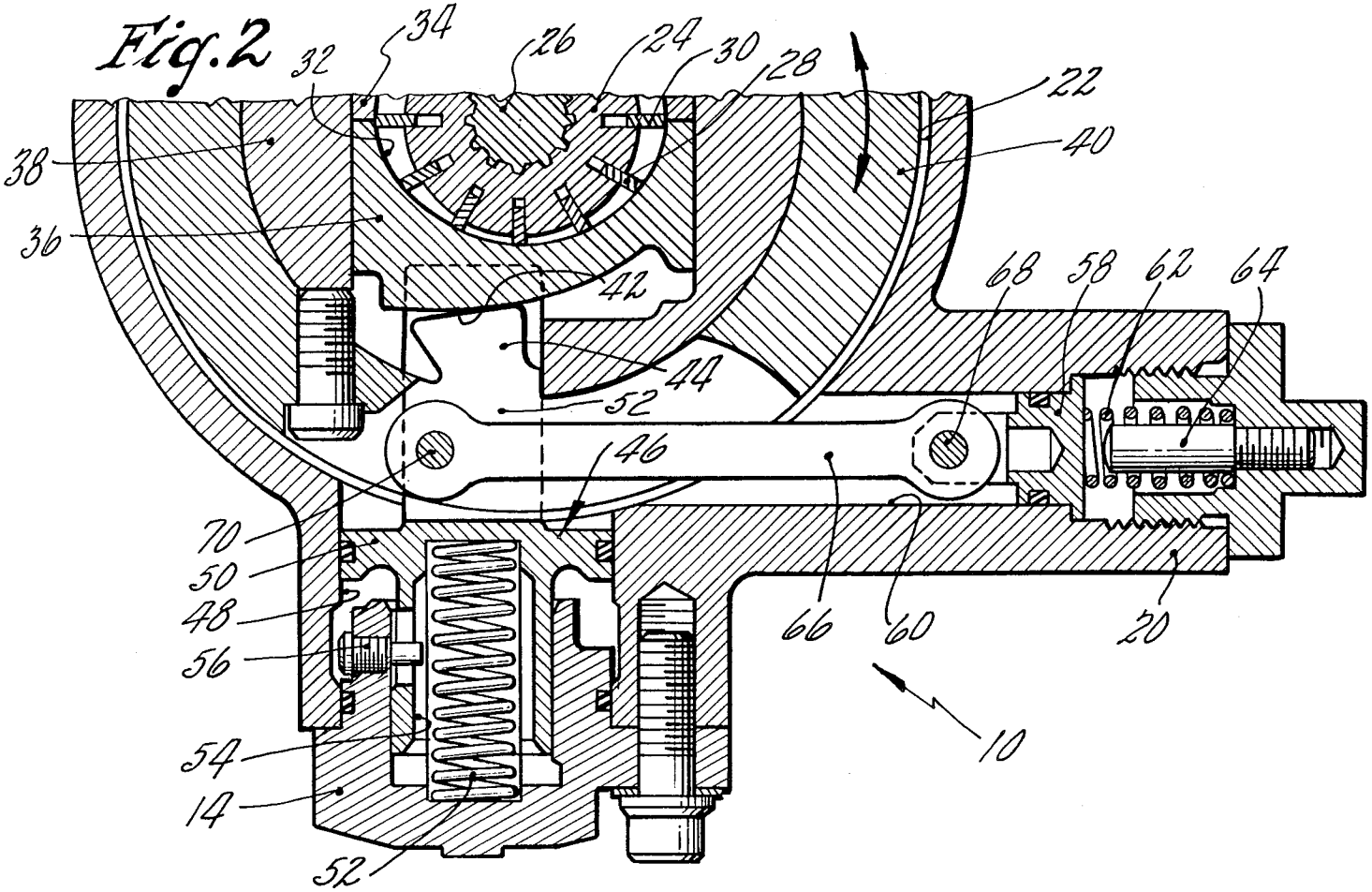
FIG. 2 is a fragmentary, sectional, elevational view of the pump of FIG. 1.

With reference to FIG. 2, which is a sectional view of the pump 10, it will be seen that pump 10 has a cavity or recess 22. Within cavity 22, a rotor 24, splined upon and driven by a drive shaft 26 which extends through the cavity, is mounted for rotation. A plurality of vanes 28 are slideably mounted in slots 30 positioned around the periphery of the rotor 24. The radially inward portions of the slots are referenced to discharge pressure to radially urge the vanes in a radially outward direction, thereby supplementing the centrifugal force.

The outer ends or tips of the vanes 28 engage a smooth track surface 32 defined by the respective inner peripheries of two identical, rigid track elements 34 and 36 (only one of which is shown in full). The track elements 34 and 36 are in confronting and interdigitating relationship and are slideably mounted within a frame structure 38 such that they are each axially movable toward and away from the rotor 24 in the vertical direction of FIG. 2.

Surrounding the frame 38 is an actuation structure in the form of a cam actuation ring 40 which is rotatable thereabout. The actuation ring 40 is provided with two diametrically opposed cam members which respectively co-act with diametrically opposed cam surfaces respectively disposed on the outer periphery of the track elements 34 and 36. As shown in FIG. 2, track element 36 has a cam surface 42 which is engaged by a cam follower 44 on the actuation ring 40, the diametrically opposed cam surface and cam follower not being shown. The angular position of the actuation ring 40, as controlled by means discussed hereinafter, determines the spacing between the track elements 34 and 36, and hence, the displacement of the pump. In order to facilitate rotation of the actuation ring 40, balance pistons are mounted in the housing extensions 14 and 16 to contact the respective outer peripheries of the track elements and urge them inwardly against the pressure forces and vane forces exerted on their inner peripheries. It should be noted at this point that the balance pistons do not displace the track elements, but merely make rotation of the actuation ring easier, due to the reduced force of engagement between the cam surfaces of the track elements and the respective cam follower members of the actuation ring.

The balance piston 46 associated with the track element 36 is shown in FIG. 2, it being understood that there is an identical balance piston and associated structure in diametrically opposed relationship located in housing extension 14 (FIG. 1). Balance piston 46, which is mounted for axial sliding movement within a cavity 48 in extension 14, has an enlarged diameter portion 50 which carries a pair of spaced legs, only one of which is shown and designated 52. The spaced legs depending from the balance piston, which engage track element 36, project through slots in the frame 38 and straddle the actuation ring 40 as well as the cam surface 42. The balance piston 46 is urged against the track element 36 by pump discharge pressure ported to cavity 48 and by a compression spring 52 received in a cavity 54 in the narrow lower portion of the balance piston 46. A stop 56 is provided to limit radially inward travel of the balance piston 46.

In the illustrated pump, maximum displacement occurs when the track elements 34 and 36 occupy their respective radially inwardmost positions, as is illustrated in FIG. 2. When the track elements are permitted to move radially outwardly of the illustrated maximum displacement condition, pump displacement is progressively reduced. It will be appreciated that, during pump operation, the track elements 34 and 36 are constantly being urged in respective radially outward directions due to not only fluid pressure forces acting on the vane track but also the vane forces. The consequence of this action is that the cam surfaces are urged against their respective cam followers on the actuation ring 40, which urging tends to occasion a rotation of the actuation ring 40 in a counterclockwise direction. In accordance with the invention, the rotation of the actuation ring is controlled so that pump displacement may be reduced at higher speeds either in a sudden or gradual manner as is befitting to the selected application.

Identical bias force torque assemblies are mounted in the extensions 18 and 20 to provide a predetermined torque upon the actuation ring 40 to prevent radially outward movement of the track elements 34 and 36 from their illustrated maximum displacement positions until a predetermined pump speed is attained. Such a speed will produce a generally predictable counter torque. The bias force or torque assembly associated with track element 36 includes a piston 58 mounted for axial sliding movement in a passage 60 in the extension 20. The piston 58 is urged to the left by a compression spring 62 mounted in an enlarged diameter segment of the passage and coiled around a piston stop and spring guide 64 threadably inserted in the extension. Piston 58 has a leg to which is pivotally attached one end of a link 66 by means of a pin 68. The link 66, which extends through passage 60 into the pumping cavity 22, has its other end pivotally connected to the actuation ring by a pin 70. Both sides of the piston 58 are reference to inlet pressure (as is the entire pumping cavity 22 with the exception of that annular volume bounded by the outer periphery of the rotor 24 and the vane track 32) whereby the only forces essentially acting on the piston 58 are those transmitted by the spring 62 and the link 66.

During operation at engine starting and low engine speeds, the track elements 34 and 36 are maintained in their respective maximum displacement positions by the bias torque assemblies applying a torque (through pin 70 in the case of the bias torque assembly in housing extension 20) to the actuation ring which is greater than that applied thereto by the cam surfaces on the track elements 34 and 36. As engine speed, and hence pump speed, increases, the pressure forces and vane forces acting on the track elements will eventually cause the track elements to move outwardly, overcoming the forces applied thereupon by the cam followers on the actuation ring 40, which will produce a counterclockwise rotation of the actuation ring 40. Counterclockwise rotation of the actuation ring 40 will terminate upon the springs in the bias torque assemblies becoming sufficiently compressed to allow the pistons in the assemblies to engage the stops therein. Upon the pistons engaging the stops in the bias torque assembles, the track elements 34 and 36 will be spaced a greater distance from the rotor (in the vertical direction of FIG. 2) than at engine starting in their new respective minimum displacement positions. As the pump is shutdown, the springs in the bias torques assemblies will, of course, return the track elements 34 and 36 to the illustrated positions.

Figure 3:
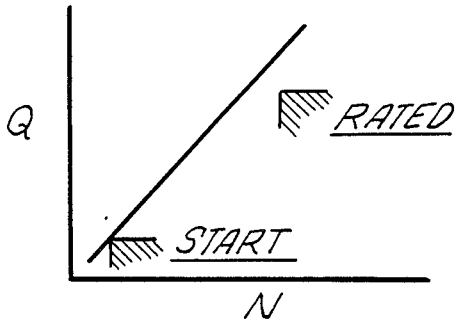
Fig.3 (PRIOR ART)
FIG. 3 is a graph showing flow versus speed for a fixed displacement pump.
Figure 3:
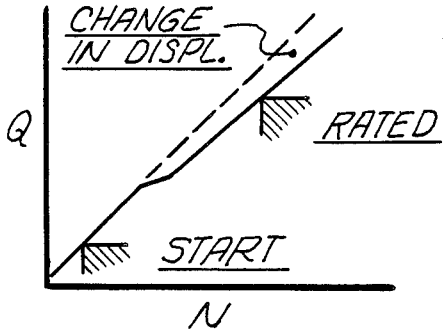
Fig.3 (PRIOR ART)

As shown in FIG. 3, in a fixed displacement fuel control system for a gas turbine engine, pump output is excessive at higher speeds, thereby mandating increased fuel bypassing (which results in great fuel heating) to maintain a constant head across a metering valve. In contradistinction thereto, a characteristic of a pump of the invention is that far less fuel flow is generated at increased speeds after a certain speed is achieved than would be possible if the pump displacement remained unchanged. As shown in FIG. 4, a salient consequence of this displacement variation is that flow from the pump can be constrained to approach rated flow conditions which are just sufficient for engine and fuel control operation and do not entail a large bypass flow.

It will be appreciated by those skilled in the art that displacement reduction can be tailored in a facile manner to fulfill specific engine requirements such as thrust levels or service limits. Moreover, the springs in the bias torque assemblies need not be designed for compression in a narrow speed range but could instead be capable of gradual compression over a wide speed range such that the flow versus speed characteristic would be non-linear. In addition, it is also possible to impart movement to only one of the track elements (with the other being mounted in a stationary position) to reduce displacement. This modification would allow for the elimination of a track element cam surface, a cam follower, a balance piston and a bias torque assembly. While the means shown for controlling movement of the track elements is a cam ring incorporating two cam follower members thereupon, it will be appreciated that any actuation structure having a cam surface thereon could be employed to displace the track elements, but that the utilization of two diametrically opposed cam follower members prevents the actuation ring 40 from bearing against the frame and engendering friction which would be detrimental to the control of the pump.

It will be understood, of course, that while the form of the invention shown and described herein constitutes the preferred embodiment of the invention, it is not intended herein to illustrate all of the possible and equivalent forms or ramifications of the invention which fall within the scope of the subjoined claims. It will also be understood that the words used are words of description rather than of limitation, in that various changes, such as changes in shape, relative size and arrangement of the parts, may be substituted without departing from the spirit and scope of the invention herein disclosed.

What is claimed is:

1. An improved variable displacement vane pump of the type having: a housing; a rotor with a plurality of radially movable vanes mounted for rotation in the housing; a first track element and a second track element mounted in the housing in confronting relationship and defining a smooth track surface for the vanes, the first track element being movable toward and away from the rotor and the second track element and having a cam surface thereupon; an actuation structure, having a cam follower, mounted in the housing such that the cam follower engages the cam surface for controlling the position of the first track element to vary the pump displacement, wherein the improvement comprises:

the cam surface and cam follower being engagable such that movement of the first track element away from the rotor produces a corresponding movement of the actuation structure;

bias force means to apply a bias force to the actuation structure to prevent movement of the actuation structure and the first track element until the fluid pressure forces and vane forces acting on the first track element cause the cam surface to exert a greater force on the actuation structure in opposition to that of the bias force and to thereafter permit predetermined movement of first track element to a new position, the bias force means comprising:

a link in the housing pivotally connected to the actuation structure;

a piston mounted in the housing for axial movement and pivotally connected to the link; and a compression spring mounted in the housing in engagement with the piston for applying a force on the piston in opposition to that applied thereto by the link.

2. An improved variable displacement vane pump of the type having: a housing; a rotor with a plurality of radially movable vanes mounted for rotation in the housing; a first tract element and a second track element mounted in the housing in confronting relationship and defining a smooth track surface for the vanes, the first and second track elements being movable toward and away from the rotor and the track elements having respective cam surfaces thereupon; an actuation structure, having a two cam followers, mounted in the housing such that the cam followers respectively engage the cam surfaces for controlling the position of the track elements to vary the pump displacement, wherein the improvement comprises:

the cam surfaces and cam followers being engagable such that movement of the track elements away from the rotor produces a corresponding movement of the actuation structure;

bias force means to apply a bias force to the actuation structure to prevent movement of the actuation structure and the track elements until the fluid pressure forces and vane forces acting on the track elements cause the cam surfaces to exert a greater force on the actuation structure in opposition to that of the bias force and to thereafter permit predetermined respective movement of tract elements to new positions, the bias force means comprising:

two links in the housing pivotally connected to the actuation structure;

two pistons mounted in the housing for axial movement and respectively connected to the links; and two compression springs mounted in the housing in respective engagement with the pistons for applying forces on the pistons in opposition to those applied thereto by the link.

3. The improved pump of claim 1, wherein the pump is further of the type in which the actuation structure comprises a cam actuation ring mounted in the housing in surrounding concentric relationship to the rotor for rotation and wherein the cam follower is integral with the actuation ring.

4. The improved pump of claim 2, wherein the pump is further of the type in which the actuation structure comprises a cam actuation ring mounted in the housing in surrounding concentric relationship to the rotor for rotation and wherein the cam followers are integral with the actuation ring.

* * * * *